US012281545B2

(12) United States Patent
Kostrov et al.

(10) Patent No.: US 12,281,545 B2
(45) Date of Patent: Apr. 22, 2025

(54) METHOD AND APPARATUS FOR SEISMIC STIMULATION OF OIL-BEARING PRODUCTION FORMATIONS

(71) Applicants: Sergey Kostrov, Frisco, TX (US); Bill Wooden, McKinney, TX (US)

(72) Inventors: Sergey Kostrov, Frisco, TX (US); Bill Wooden, McKinney, TX (US)

(73) Assignee: ZENCOR TOOLS, LLP, Frisco, TX (US)

( * ) Notice: Subject to any disclaimer, the term of this patent is extended or adjusted under 35 U.S.C. 154(b) by 0 days.

(21) Appl. No.: 18/152,295

(22) Filed: Jan. 10, 2023

(65) Prior Publication Data

US 2024/0229609 A1 Jul. 11, 2024

(51) Int. Cl.
*E21B 43/12* (2006.01)
*E21B 43/00* (2006.01)
*E21B 43/16* (2006.01)

(52) U.S. Cl.
CPC ..... *E21B 43/003* (2013.01); *E21B 43/16* (2013.01)

(58) Field of Classification Search
CPC ..... E21B 43/128; E21B 43/127
See application file for complete search history.

(56) References Cited

U.S. PATENT DOCUMENTS 3,209,834 A * 10/1965 Essary ..... E21B 43/26 166/177.2
4,687,054 A * 8/1987 Russell ..... H02K 33/14 166/66.4
5,586,602 A * 12/1996 Vagin ..... E21B 28/00 166/177.2
7,316,270 B2 * 1/2008 Shen ..... E21B 43/128 166/66.4
10,156,108 B2 * 12/2018 Kostrov ..... E21B 43/003
10,634,131 B2 * 4/2020 Khachaturov ..... H02K 1/12
2006/0249286 A1 * 11/2006 Serdjukov ..... E21B 28/00 166/105

* cited by examiner

*Primary Examiner* — Kenneth L Thompson
(74) *Attorney, Agent, or Firm* — Laubscher & Fretwell, P.C.

(57) ABSTRACT

The method and apparatus for producing shock waves in a well wherein a device connected to the bottom of the tubing string in the borehole of the well filled by liquid and containing the upper and lower plungers movably arranged within corresponding cylinders for compressing a liquid inside the compression chamber and discharging the liquid into the borehole on upstroke thereby generating a shock wave. In addition, providing a required force N of said linear permanent magnet motor for the mover determined by the following expression:

$$N \geq \left[\frac{\pi}{4}(D_1^2 - D_2^2)A_{SW} + g(M_1 + M_2)(1 + k_f)\right],$$

where $D_1$ is the outside diameter of the lower plunger, $D_2$ is the outside diameter of the upper plunger, $A_{sw}$ is the required amplitude of the generated shock wave, $M_1$ is a mass of the lower and upper plungers, $M_2$ is the mass of sucker rods, $k_f$ is a friction coefficient between plungers and corresponding cylinders, g is a gravity of acceleration.

8 Claims, 2 Drawing Sheets

METHOD AND APPARATUS FOR SEISMIC STIMULATION OF OIL-BEARING PRODUCTION FORMATIONS

BACKGROUND OF THE INVENTION

The present invention relates to a shock wave generating method and device and, more particularly, to a method and device for repeatedly generating shock waves in a well borehole to increase oil recovery and oil production and to carry out continuous seismic surveys of an oil-bearing formation.

BRIEF DESCRIPTION OF PRIOR ART

The U.S. Pat. Nos. 6,015,010, 6,899,175 and 7,980,301 disclose methods and apparatuses for increasing the efficiency of shock wave stimulation of oil-bearing formations. However the implementation of methods in accordance with U.S. Pat. Nos. 6,015,010, 6,899,175, 8,459,351, 7,980,301 and 10,156,108 have their drawbacks, i.e. the methods and apparatuses are not optimal from the point of view of efficiency of the devices implemented in accordance with U.S. Pat. Nos. 6,015,010, 6,899,175, 8,459,351, 7,980,301 and 10,156,108 wherein the devices are connected to the pumping unit by string of sucker rods and, as a consequence, could cause the partition of the sucker rods string due to the high periodical fatigue stress. In particularly the efficacy of the device's implementation from reliability point of view could be substantially enhanced by eliminating of sucker rods string between the device and the pumping unit.

The present invention was developed to overcome drawbacks of prior methods and devices by providing an improved method and apparatus for producing shock waves in a borehole of a well filled or partially filled by a liquid.

SUMMARY OF INVENTION

Accordingly, a primary object of the present invention is to provide an apparatus for producing a shock wave in wells filled or partially filled by a liquid which includes, the tubing string extending downwardly into the borehole of the well filled or partially filled by the liquid, a linear permanent magnet motor connected to the bottom of the tubing string at the upper end and said linear permanent magnet motor is connected to the upper cylinder at the lower end, a mover of the linear permanent magnet motor connected to the upper plunger, movably arranged within said upper cylinder, a lower cylinder connected via a compression chamber to said upper cylinder having the smaller internal diameter than said lower cylinder, a lower plunger movably arranged within said lower cylinder, and said upper and lower plungers are connected to each other by means of at least one rod for compressing a liquid contained within said compression chamber and discharging the liquid into the borehole of the well when said lower plunger exits out of said lower cylinder on the upstroke of said mover of the linear permanent magnet motor thereby generating a shock wave.

It is another object of the invention to provide the method for producing a shock wave in wells filled or partially filled by liquid comprising the steps of: positioning a device connected to a bottom of a tubing string extending downwardly into the borehole of the well filled or partially filled by the liquid and consisting of a linear permanent magnet motor connected to the bottom of the tubing string at the upper end, and said linear permanent magnet motor is connected to the upper cylinder at the lower end, a mover of linear permanent magnet motor connected to the upper plunger, movably arranged within the upper cylinder, lower cylinder connected to said upper cylinder via a compression chamber and said upper cylinder has a smaller internal diameter than an internal diameter of said lower cylinder, lower plunger connected to said upper plunger by means of at least one sucker rod and said upper and lower plungers movably arranged within said upper and lower cylinders, correspondingly, for compressing the liquid contained within said compression chamber and discharging the liquid into the borehole when said lower plunger exits out of said lower cylinder on the upstroke of said mover of the linear permanent magnet motor thereby generating a shock wave and providing a required force N of said linear permanent magnet motor for the mover determined by the following expression:

$$N \geq \left[\frac{\pi}{4}(D_1^2 - D_2^2)A_{sw} + g(M_1 + M_2)(1 + k_f)\right],$$

where $D_1$ is the outside diameter of the lower plunger, $D_2$ is the outside diameter of the upper plunger, $A_{sw}$ is the required amplitude of the generated shock wave, $M_1$ is a mass of the lower and upper plungers, $M_2$ is the mass of sucker rods, $k_f$ is a friction coefficient between plungers and corresponding cylinders, g is a gravity of acceleration.

It is another object of the invention to provide the method for producing a shock wave in wells filled or partially filled by liquid in which the length of stroke $L_s$ of mover determined by the following expression:

$$L_s \geq L + \frac{L_1}{d_r^2 E}\left[(D_1^2 - D_2^2)A_{sw} + \frac{2gL_1(\rho_s - \rho_f)}{\pi}\right],$$

where L is the length of the lower cylinder, $L_1$ is the distance between the top of the lower plunger and the bottom of the upper plunger, $D_1$ is the outside diameter of the lower plunger, $D_2$ is the outside diameter of the upper plunger, $A_{sw}$ is the required amplitude of the generated shock wave, E is a modulus of elasticity of the sucker rod's material, $d_r$ is the diameter of the sucker rods, $\rho_s$ is density of the sucker rods material, $\rho_f$ is the density of fluid in compression chamber, $\pi$=3.1415, g is a gravity of acceleration.

It is a further object of the invention to provide the method for producing a shock wave in wells filled or partially filled by liquid in which the speed V of the mover of said linear permanent magnet motor during the upward stroke is determined by the following expression:

$$\frac{Ln_1}{30} \leq v \leq \frac{Ln_2}{30},$$

where L is the length of the lower cylinder, $n_1$ is the minimum number of said strokes per minute, $n_2$ is the maximum number of strokes per minute.

BRIEF DESCRIPTION OF THE DRAWINGS

Other objects and advantages of the invention will become apparent from the study of the following specification when viewed considering the accompanying drawings, in which.

DETAILED DESCRIPTION

Figure 1:
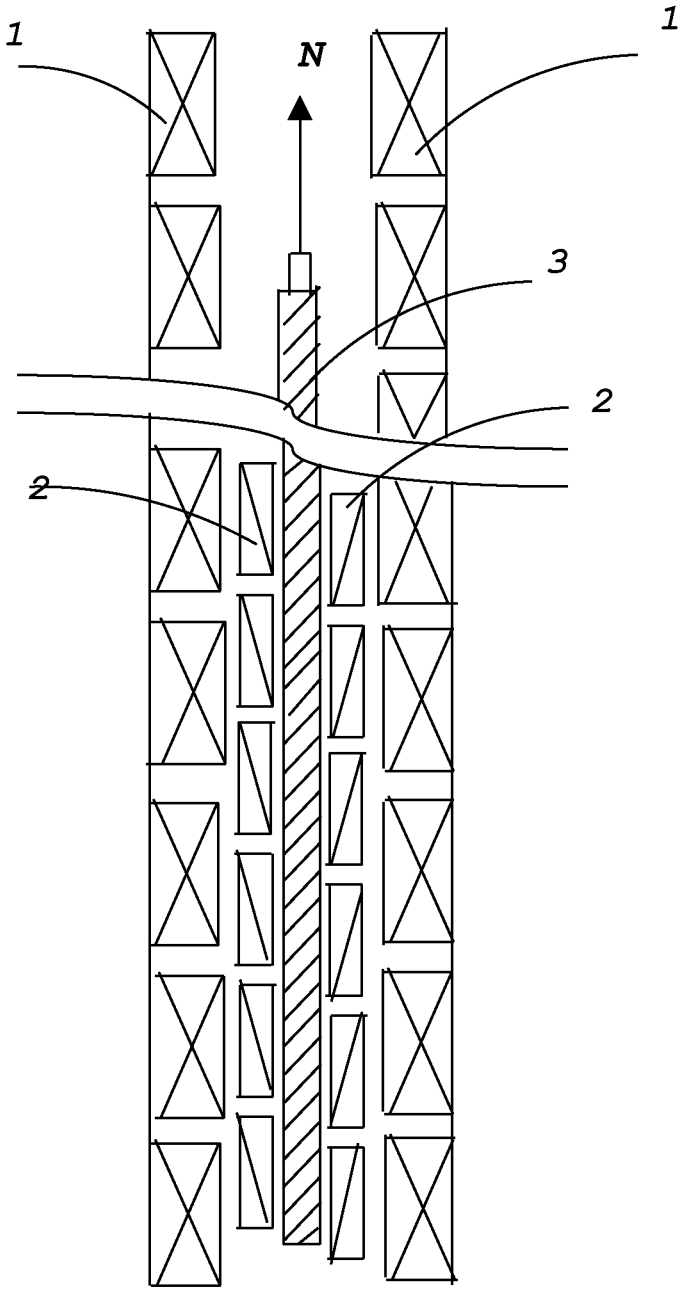
FIG. 1 is a cross-sectional side view of linear permanent magnet motor.
Figure 2:
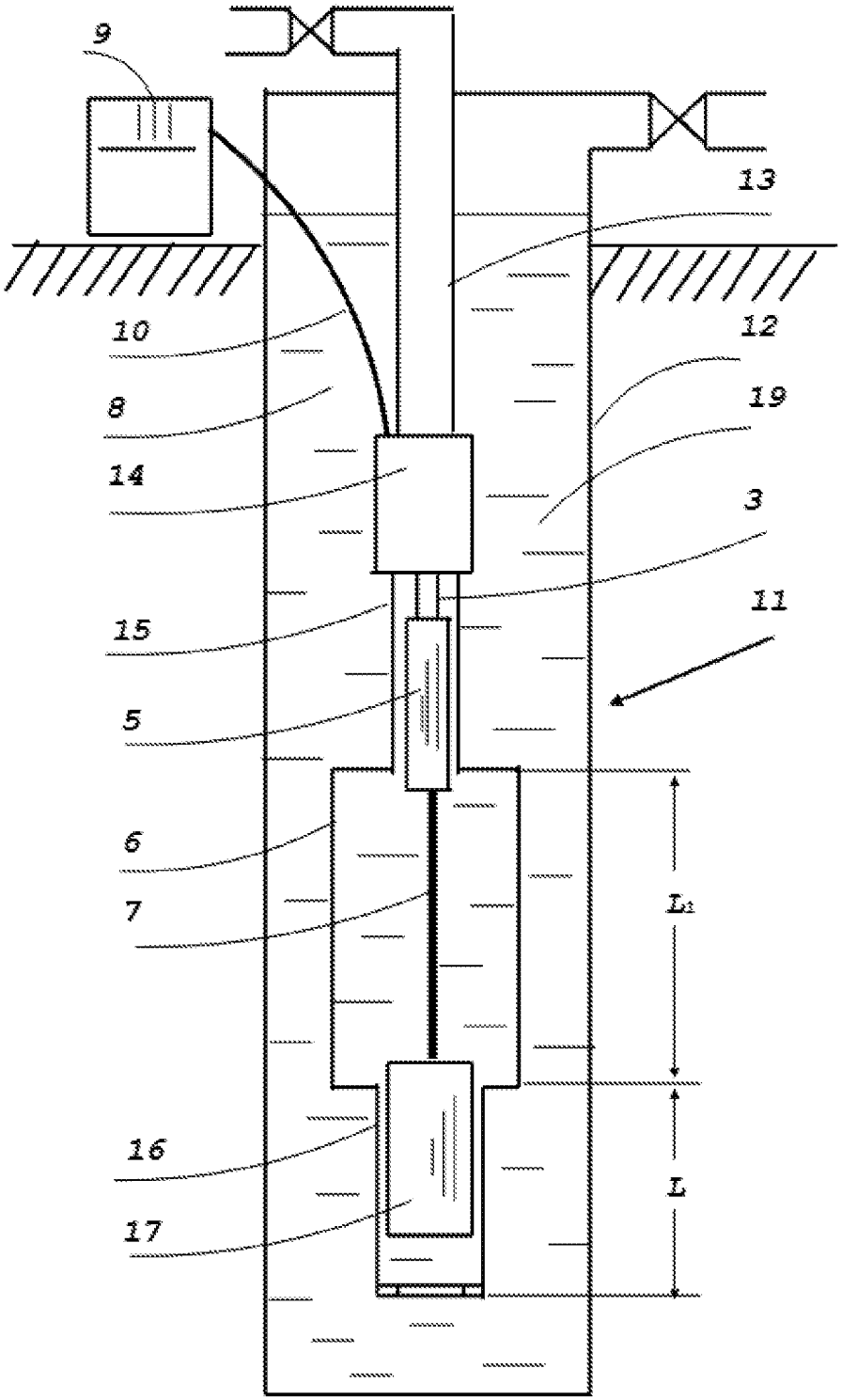
FIG. 2 is a cross-sectional side view of the device installed in the well borehole according to the invention.

Referring to FIGS. 1 and 2 there is shown a device for producing a shock wave in borehole 19 of a well 11 filled or partially filled by liquid 8. The device includes a tubing string 13 extending downwardly into the production casing 12 of the well, the linear permanent magnet motor 14 is connected to the bottom of the tubing string 13 at the upper end and said linear permanent magnet motor 14 is connected to the upper cylinder 15 at the lower end, a mover 3 of the linear permanent magnet motor 14 connected to the upper plunger 5, movably arranged within said upper cylinder 15, a lower cylinder 16 connected via a compression chamber 6 to said upper cylinder 15 having the smaller internal diameter than said lower cylinder 16, the lower plunger 17 movably arranged within said lower cylinder 16, and said upper 5 and lower 17 plungers are connected to each other by means of at least one sucker rod 7 for compressing a liquid contained within said compression chamber 6 and discharging the liquid into the borehole 19 of the well when said lower plunger 17 exits out of said lower cylinder 16 on the upstroke of the mover 3 of the linear permanent magnet motor 14 thereby generating a shock wave.

The linear permanent magnet motor 14 (FIG. 1) offers several advantages including high speed, acceleration, positioning accuracy and high power and force. The linear permanent magnet motor 14 consists of a stator 1, a permanent magnet 2 and a mover 3. The way it works is by two pairs (sometimes one) of magnetic rectangular fins 2, the fins 2 produce a North-to-North magnetic push causing the motion of the mover 3. The linear permanent magnet motor 14 is connected to the control surface equipment 9 by cable 10.

As shown on FIG. 2, the mover 3 must go upward to provide the exit of the lower plunger 17 out of lower cylinder 16 to generate the shock wave. The linear permanent magnet motor 14 must create a required force N of said linear permanent magnet motor for the mover 3 during the upward motion determined by the following expression:

$$N \geq \left[\frac{\pi}{4}(D_1^2 - D_2^2)A_{SW} + g(M_1 + M_2)(1 + k_f)\right],$$

where $D_1$ is the outside diameter of the lower plunger 17, $D_2$ is the outside diameter of the upper plunger 5, $A_{sw}$ is the required amplitude of the generated shock wave, $M_1$ is a mass of the lower and upper plungers (5 and 17), $M_2$ is the mass of sucker rods 7, $k_f$ is a friction coefficient between plungers and corresponding cylinders, g is a gravity of acceleration.

In particular, N≥33190 N for the following parameters: $D_1$=0.082 m, $D_2$=0.07 m, $$A_{sw} = 21 \times 10^6 \text{ Pa}, M_1 = 155 \text{ kg}, M_2 = 90 \text{ kg}, k_f = 0.15, g = 9.81 \text{ m/s}^2$$

As shown on FIG. 2, on the top of upstroke of a mover 3 of the linear permanent magnet motor 14 the lower plunger 17 must exit out of the lower cylinder 16 in order to generate a shock wave. In this case the length of stroke $L_s$ of the mover 3 is determined by the following expression:

$$L_s \geq L + \frac{L_1}{d_r^2 E}\left[(D_1^2 - D_2^2)A_{sw} + \frac{2gL_1(\rho_s - \rho_f)}{\pi}\right],$$

where L is the length of the lower cylinder 16, $L_1$ is the distance between the top of the lower plunger 17 and the bottom of the upper plunger 5, $D_1$ is the outside diameter of the lower plunger 17, $D_2$ is the outside diameter of the upper plunger 5, $A_{sw}$ is the required amplitude of the generated shock wave, E is a modulus of elasticity of the sucker rod's material 7, $d_r$ is the diameter of the sucker rods 7, $\rho_s$ is density of the sucker rods material, $\rho_f$ is the density of fluid in compression chamber 6, $\pi$=3.1415, g is a gravity of acceleration.

In particular, $L_s$≥3.61 m for the following parameters: $D_1$=0.082 m, $D_2$=0.07 m, $$A_{sw} = 21 \times 10^6 \text{ Pa}, \rho_s = 7800 \text{ kg/m}^3, \rho_f = 1000 \text{ kg/m}^3,$$

$$E = 2.12 \times 10^{11} \text{ Pa}, d_r = 0.0254 \text{ m}, L_1 = 30 \text{ m}, L = 3.6 \text{ m}, g = 9.81 \text{ m/s}^2.$$

As shown on FIG. 2, the speed V of the mover 3 of said linear permanent magnet motor 14 during the upward stroke is determined by the following expression:

$$\frac{Ln_1}{30} \leq v \leq \frac{Ln_2}{30},$$

where L is the length of the lower cylinder 16, $n_1$ is the minimum number of strokes per minute of mover 3, $n_2$ is the maximum number of strokes per minute of mover 3.

In particular, 1.2≥V≥0.48 m/s for $n_1$=4, $n_2$=10 and L=3.6 m.

While in accordance with the provisions of the Patent Statutes the preferred forms and the embodiments of the invention have been illustrated and described, it will be apparent to those of ordinary skill in the art various changes and modifications may be made without deviating from the inventive concepts set forth above.

What is claimed is:

1. An apparatus for producing shock waves in a borehole of a well filled or partially filled by a liquid for stimulation of production horizons of fluid bearing formations, comprising:

a) a tubing string extending downwardly into the borehole of the well filled or partially filled by the liquid;

b) a linear permanent magnet motor being connected and adjacent to a bottom of the tubing string at an upper end and an upper cylinder at a lower end, said linear permanent magnet motor having a mover connected with an upper plunger movably arranged within said upper cylinder;

c) a lower cylinder connected via a compression chamber to said upper cylinder having a smaller internal diameter than said lower cylinder; and d) a lower plunger movably arranged within said lower cylinder, said upper and lower plungers being connected to each other by means of at least one rod for compressing a liquid contained within said compression chamber and discharging the liquid into the borehole of the well when said lower plunger exits out of said lower cylinder on the upstroke of the pumping unit thereby generating a shock wave.

2. A method for producing the shock waves in borehole of a well filled or partially filled by a liquid for stimulation of production horizons of fluid bearing formations, comprising the steps of:

a) positioning a device connected to a bottom of a tubing string extending downwardly into the borehole of the well filled or partially filled by the liquid and comprising:

i) a linear permanent magnet motor connected to the bottom of the tubing string at the upper end and said linear permanent magnet motor is connected to the upper cylinder at the lower end;

ii) a mover of linear permanent magnet motor connected to the upper plunger, movably arranged within said upper cylinder;

iii) a lower cylinder connected to said upper cylinder via a compression chamber and said upper cylinder has a smaller internal diameter than an internal diameter of said lower cylinder;

iv) a lower plunger connected to said upper plunger by means of at least one sucker rod and said upper and lower plungers movably arranged within said upper and lower cylinders, correspondingly, for compressing the liquid contained within said compression chamber and discharging the liquid into the borehole when said lower plunger exits out of said lower cylinder on the upstroke of said mover of linear permanent magnet motor thereby generating a shock wave;

b) providing a required force N of said linear permanent magnet motor for said mover determined by the following expression:

$$N \geq \left[\frac{\pi}{4}(D_1^2 - D_2^2)A_{sw} + g(M_1 + M_2)(1 + k_f)\right],$$

where $D_1$ is the outside diameter of the lower plunger, $D_2$ is the outside diameter of the upper plunger, $A_{sw}$ is the required amplitude of the generated shock wave, $M_1$ is a mass of the lower and upper plungers, $M_2$ is the mass of sucker rods, $k_f$ is a friction coefficient between plungers and corresponding cylinders, g is a gravity of acceleration.

3. A method as define in claim 2 wherein the length of stroke Ls of said mover determined by the following expression:

$$L_s \geq L + \frac{L_1}{d_r^2 E}\left[(D_1^2 - D_2^2)A_{SW} + \frac{2gL_1(\rho_s - \rho_f)}{\pi}\right],$$

where L is the length of the lower cylinder, $L_1$ is the distance between the top of the lower plunger and the bottom of the upper plunger, $D_1$ is the outside diameter of the lower plunger, $D_2$ is the outside diameter of the upper plunger, $A_{sw}$ is the required amplitude of the generated shock wave, E is a modulus of elasticity of the sucker rod's material, $d_r$ is the diameter of the sucker rods, $\rho_s$ is density of the sucker rods material, $\rho_f$ is the density of fluid in compression chamber, $\pi$=3.1415, g is a gravity of acceleration.

4. A method as define in claim 2 wherein the speed V of said mover of said linear permanent magnet motor during the upward stroke is determined by the following expression:

$$\frac{Ln_1}{30} \leq v \leq \frac{Ln_2}{30},$$

where L is the length of the lower cylinder, $n_1$ is the minimum number of said strokes per minute, $n_2$ is the maximum number of said strokes $L_s$ per minute.

5. The apparatus for producing shock waves in a borehole of a well as defined in claim 1, wherein said linear permanent magnet motor is arranged below the tubing string.

6. The apparatus for producing shock waves in a borehole of a well as defined in claim 5, wherein said linear permanent magnet motor is arranged above the upper plunger.

7. An apparatus for producing shock waves in a borehole of a well filled or partially filled by a liquid for stimulation of production horizons of fluid bearing formations, comprising:

a) a tubing string extending downwardly into the borehole of the well filled or partially filled by the liquid;

b) a linear permanent magnet motor being connected and adjacent to a bottom of the tubing string at an upper end and an upper cylinder at a lower end, said linear permanent magnet motor having a mover connected with an upper plunger movably arranged within said upper cylinder c) a lower cylinder connected via a compression chamber to said upper cylinder having a smaller internal diameter than said lower cylinder d) a lower plunger movably arranged within said lower cylinder, said upper and lower plungers being connected to each other by means of at least one rod for compressing a liquid contained within said compression chamber and discharging the liquid into the borehole of the well when said lower plunger exits out of said lower cylinder on the upstroke of the pumping unit thereby generating a shock wave; and e. a production casing, wherein said linear permanent magnet motor is arranged within said production casing.

8. The apparatus for producing shock waves in a borehole of a well as defined in claim 7, wherein said linear permanent magnet motor is arranged between the tubing string and the upper plunger.

* * * * *